United States Patent [19]

Nuckolls

[11] 3,963,958

[45] June 15, 1976

[54] STARTING AND OPERATING CIRCUIT FOR GASEOUS DISCHARGE LAMPS

[75] Inventor: Joe A. Nuckolls, Hendersonville, N.C.

[73] Assignee: General Electric Company, New York, N.Y.

[22] Filed: Nov. 18, 1974

[21] Appl. No.: 524,654

Related U.S. Application Data

[63] Continuation of Ser. No. 674,508, Oct. 11, 1967, abandoned.

[52] U.S. Cl. ..... 315/276; 315/DIG. 5; 315/289

[51] Int. Cl.[2] ..... H05B 37/00

[58] Field of Search ..... 315/DIG. 5, 176, 276, 315/278, 289

[56] References Cited

UNITED STATES PATENTS

| | | | |
|---|---|---|---|
| 2,575,001 | 11/1951 | Bird | 315/276 |
| 3,037,147 | 5/1962 | Genuit et al. | 315/289 X |
| 3,235,769 | 2/1966 | Wattenbach | 315/176 |
| 3,364,386 | 1/1968 | Segawa et al. | 315/DIG. 5 X |
| 3,407,334 | 10/1968 | Attewell | 315/278 |

FOREIGN PATENTS OR APPLICATIONS

| | | |
|---|---|---|
| 17-292 | 1/1942 | Japan |

*Primary Examiner*—R. V. Rolinec
*Assistant Examiner*—Lawrence J. Dahl
*Attorney, Agent, or Firm*—Sidney Greenberg

[57] ABSTRACT

Operating circuits for gaseous discharge lamps such as those of metal vapor type having ballast devices of conventional type are provided with high voltage generating devices for applying high voltage starting pulses on the lamp, comprising a charging capacitor and a neon glow tube forming a series discharge loop with a selected number of turns of the ballast coil winding at its output end.

9 Claims, 5 Drawing Figures

STARTING AND OPERATING CIRCUIT FOR GASEOUS DISCHARGE LAMPS

This is a continuation of application Ser. No. 674,508 filed Oct. 11, 1967, now abandoned.

The present invention relates to discharge lamp operating and starting circuits, and especially to discharge lamps requiring a starting voltage substantially higher than the operating voltage.

It is an object of the invention to provide a simple, reliable and economical starting and operating circuit for gaseous discharge lamps which require high starting voltages.

It is a particular object of the invention to provide a starting and operating circuit for discharge lamps of the above described type which employ lamp ballast devices of conventional type.

It is still another object of the invention to provide a starting circuit of the described type which automatically ceases operation once the lamp has started.

Other objects and advantages will become apparent from the following description and the appended claims.

With the above objects in view, the present invention relates to a starting and operating circuit for gaseous discharge lamps comprising ballasting means, means for connecting the ballasting means at its input side to a source of alternating current, discharge lamp means connected to the output side of the ballasting means, and high voltage starting means including a portion of the ballasting means connected to the ballasting means at its output side for providing a high voltage starting pulse on the discharge lamp means.

The invention will be better understood from the following description taken in conjunction with the accompanying drawings, in which.

Figure 1:
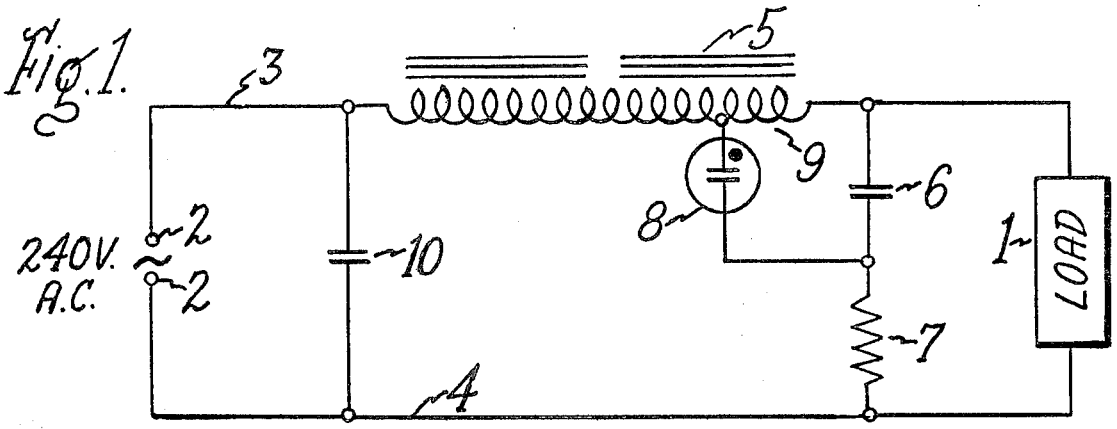
FIG. 1 is a circuit diagram of a lamp starting and operating circuit in which the invention is associated with a reactor ballast.

Referring now to the drawings, and particularly to FIG. 1, there is shown a starting and operating circuit for a gaseous discharge lamp 1, such as a sodium or other metal vapor lamp, which requires a relatively high voltage pulse in order to be ignited and which thereafter operates on a lower voltage, e.g., 240 volts. Lamp 1 is connected by line conductors 3 and 4 across terminals 2 of an alternating current source, typically 240 volts, with inductive reactance ballast 5 connected in series therewith to provide a current limiting impedance, as is conventional in discharge lamp circuits. In order to provide high voltage starting pulses, e.g., of 2 or 3 kilovolts, on lamp 1, there is provided in the FIG. 1 embodiment a high voltage pulse generator comprising capacitor 6 and resistor 7 connected in series across lamp 1 on the output side of reactor 5, and a voltage sensitive symmetrical switch 8, such as a neon glow lamp, which is a bi-laterally conducting gas tube and which becomes conductive only upon the application of a predetermined voltage thereon. Other types of voltage sensitive bi-laterally conducting switch devices may be used instead of a neon glow lamp, as for example, oppositely poled parallel connected controlled rectifiers, Shockley diodes, triacs (a-c semiconductor switch with single control electrode) or other equivalent switch devices or circuits. As shown, glow lamp 8 is connected across capacitor 6 and a predetermined number of turns 9 of reactor ballast 5 at the output end thereof, so that glow lamp 8 is in series discharge relation with capacitor 6 and the tapped turns 9 of ballast 5 in series therewith.

The number of turns thus tapped off at the output end should be sufficient to completely couple in an autotransformer action the high voltage across the entire winding of reactor 5. The actual number of turns involved dictates the pulse inductance of the discharge loop. If the inductance is too small, the peak current in the discharge loop is too large, resulting in high resistance voltage drops around the loop and high switch losses, thus lowering the high voltage magnitude and energy level applied to lamp 1. In a typical arrangement, the ratio of total turns to tapped turns selected is about 12 to 1, which usually suffices to provide good coupling and adequate peak output voltage for starting lamp 1.

Connected across terminals 2 at the input side of reactor ballast 5 is capacitor 10 which serves both as a high frequency by-pass and a power factor improvement capacitor.

In the operation of the described circuit, capacitor 6 is initially charged through resistor 7 by the input voltage from the alternating current source. As the voltage across capacitor 6 rises, it reaches the breakdown potential of neon glow lamp 8. When this occurs, capacitor 6 discharges through tapped turns 9 placing, say, 275 volts, across those turns, resulting in a step-up by reactor 5 acting as a pulse transformer to a voltage of, say, about 3300 volts which appears across the total reactor turns. Pulses of this high voltage level are thereby produced across lamp 1 by the pulse generating circuit described. The line side of reactor 5 is shorted at the pulse frequency by capacitor 10. Since the pulse voltage cannot rise across capacitor 10, it must rise across resistor 7. Hence the pulse voltage appears across discharge lamp 1 in the correct polarity on each half cycle until lamp 1 starts. Upon starting of lamp 1, the pulsing mechanism is disabled as a result of the voltage clamping action of the ignited lamp load and therefore the voltage buildup across capacitor 6 does not reach the breakdown level of neon lamp 8.

Figure 2:
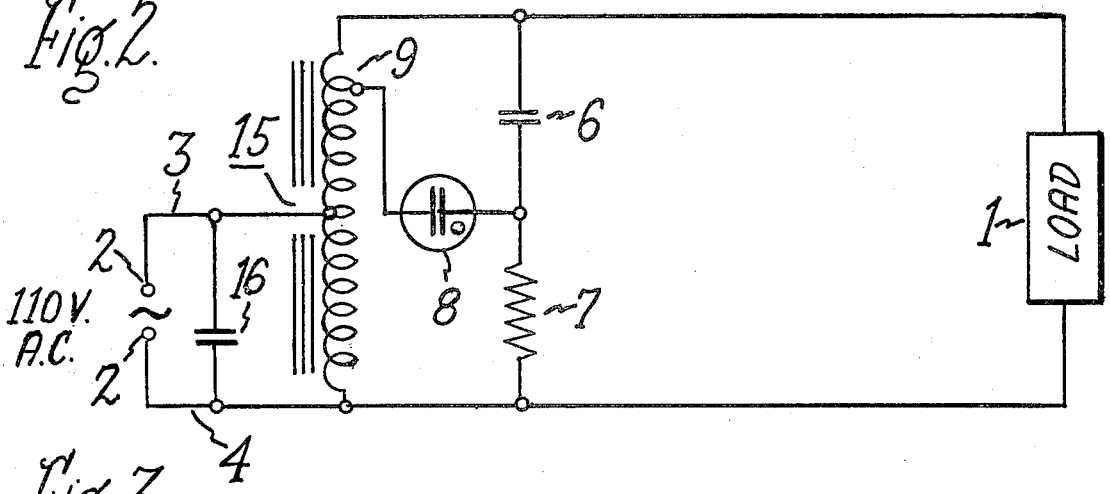
FIG. 2 is a circuit diagram in which a lag ballast is employed.

FIG. 2 shows the invention as employed in a lamp operating circuit having a lag ballast device. In this circuit, in which the components corresponding to those of the FIG. 1 circuit are designated by like numerals, the ballast comprises auto-transformer 15 connected by terminals 2 of a source of alternating current, typically 110 volts, whereby the voltage is stepped up by auto-transformer 15 to 240 volts a-c across lamp load 1. Similarly to the FIG. 1 arrangement, charging capacitor 6 and resistor 7 are connected in series across lamp 1 on the output side of auto-transformer 15, with neon glow lamp 8 connected to a tap near the output end of auto-transformer 15 so as to provide a series discharge loop including the selected number of turns 9 of the transformer. Capacitor 16 connected across the supply lines likewise serves as a power factor correction and high frequency by-pass capacitor corresponding to capacitor 10 of FIG. 1. As will be evident, the high voltage generator circuit of this arrangement will produce high voltage pulses to lamp 1 for igniting the same and cease operation after lamp starting, as described above.

Figure 3:
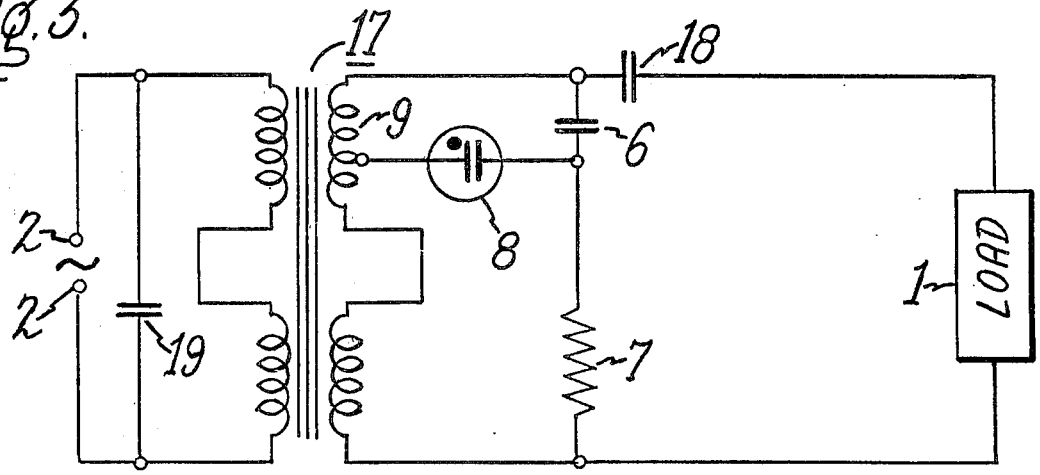
FIG. 3 is a circuit diagram in which a regulator ballast is employed.

FIG. 3 shows the invention as applied to a regulator type of ballast, which is a high reactance transformer using a capacitor in the secondary circuit thereby providing a controlled degree of saturation in the secondary magnetic circuit which provides lamp current regulation compensating for supply voltage variations. The circuit shown comprises supply terminals 2 connected to the primary windings of ballast 17, the secondary windings of the latter being connected to lamp 1 with ballast capacitor 18 in series therewith. As in the previous arrangements the high voltage generator circuit is connected across lamp 1 and at the output side of transformer 17 so as to provide high voltage starting pulses to the lamp. In this arrangement capacitor 19 serves simply as a by-pass capacitor inasmuch as ballast capacitor 18 provides the power factor correction function.

Figure 4:
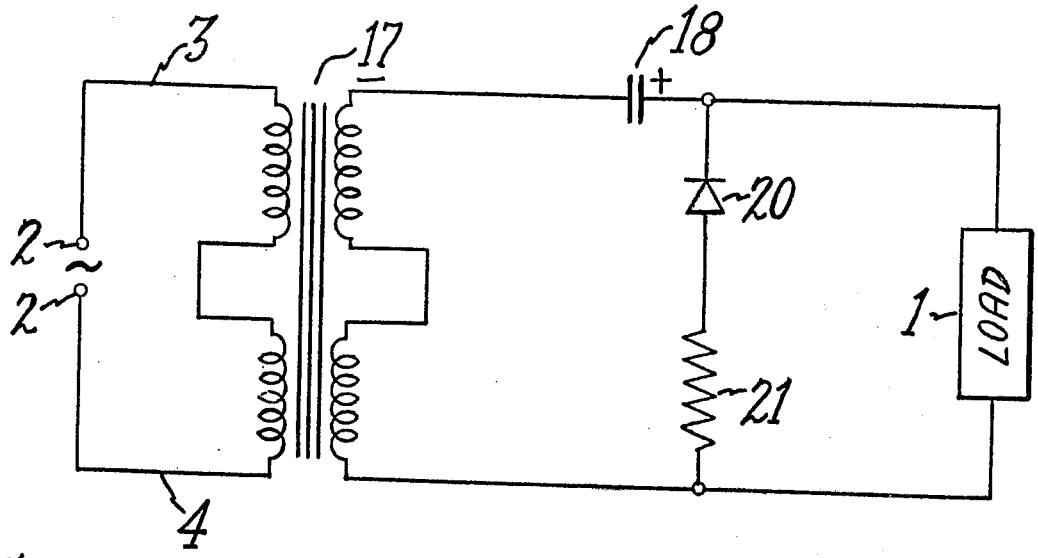
FIG. 4 is a circuit diagram of a different embodiment of the starting device of the invention used in conjunction with a regulator ballast.
Figure 5:
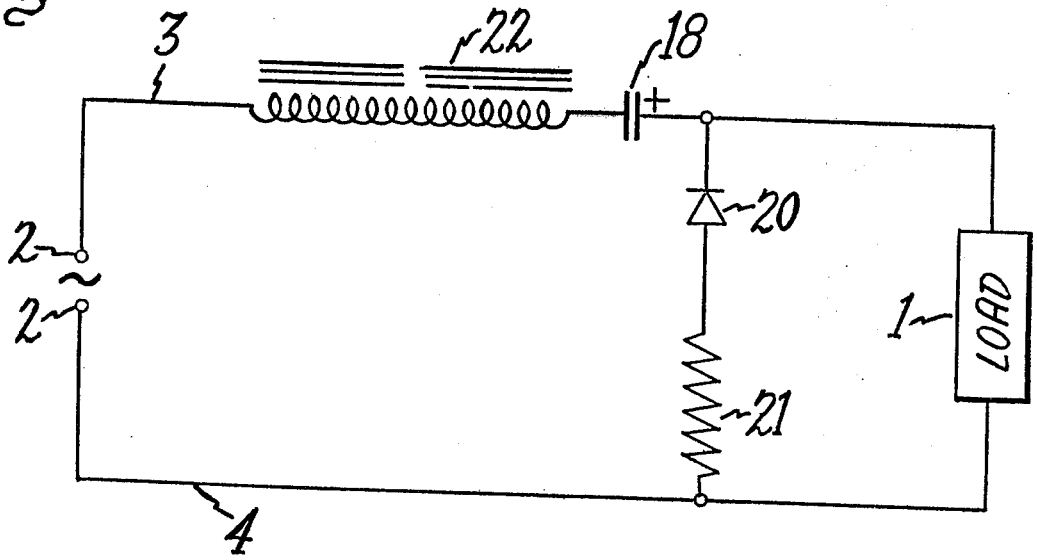
FIG. 5 is a circuit diagram similar to that of FIG. 4 in which a lead ballast is employed.

FIGS. 4 and 5 show a modified form of the high voltage generator as applied to a regulator ballast and a lead type ballast, respectively. In these cases, series —connected diode 20 and resistor 21 are connected across the lamp load 1 on the output side of the ballast components comprising regulator ballast transformer 17 and ballast capacitor 18 in the case of FIG. 4, and on the output side of reactor ballast transformer 22 and capacitor 18 of the FIG. 5 circuit. In the operation of these arrangements, as the alternating current voltage appears across the circuit prior to lamp ignition, diode 20 conducts on one-half the alternating current cycle to slowly charge ballast capacitor 18 having the polarity as shown. As the rising direct current voltage appears across capacitor 18, it sums with the alternating peak voltage on the non-charging half-cycle to double the peak a-c voltage and apply it to lamp 1 to facilitate ionization therein for starting it. Resistor 21 limits the rate of charging ballast capacitor 18 and its resistance is sufficiently high to limit its power dissipation during normal operation of the lamp.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A starting and operating circuit for gaseous discharge lamps comprising a source of alternating current, ballasting means connected at its input side to said alternating current source, discharge lamp means connected to the output side of said ballasting means, and high voltage starting means having a series discharge loop including a portion of said ballasting means connected to said ballasting means at its output side for providing a high voltage starting pulse on said discharge lamp means, said ballasting means comprising inductance coil means having a plurality of turns, said high voltage starting means comprising a charging capacitor and a resistor connected in series across said discharge lamp means, and voltage sensitive symmetrical switch means having a predetermined breakdown voltage connected across said charging capacitor and a predetermined number of turns of said inductance coil means at its output side and forming therewith a series discharge loop, said inductance coil means stepping up the voltage produced across said predetermined number of turns by operation of said discharge loop, said ballasting means comprising a linear reactor connected in series between said alternating current source and said discharge lamp means.

2. A starting and operating circuit for gaseous discharge lamps comprising a source of alternating current, ballasting means connected at its input side to said alternating current source, discharge lamp means connected to the output side of said ballasting means, and high voltage starting means having a series discharge loop including a portion of said ballasting means connected to said ballasting means at its output side for providing a high voltage starting pulse on said discharge lamp means, said ballasting means comprising inductance coil means having a plurality of turns, said high voltage starting means comprising a charging capacitor and a resistor connected in series across said discharge lamp means, and voltage sensitive symmetrical switch means having a predetermined breakdown voltage connected across said charging capacitor and a predetermined number of turns of said inductance coil means at its output side and forming therewith a series discharge loop, said inductance coil means stepping up the voltage produced across said predetermined number of turns by operation of said discharge loop, said ballasting means comprising a regulator type ballast having primary and secondary winding means, said secondary winding means connected across said discharge lamp means.

3. A circuit as defined in claim 1, including a high frequency by-pass capacitor connected across said alternating current source on the input side of said ballasting means.

4. A circuit as defined in claim 3, including a high frequency by-pass capacitor connected across said alternating current source on the input side of said ballasting means.

5. A circuit as defined in claim 3, including a ballast capacitor connected in series between said secondary winding means and said discharge lamp means.

6. Apparatus for igniting and operating discharge means from an A.C. source, said discharge means being characterized by a relatively high starting voltage with respect to its operating voltage and the voltage of said source, first means having an input connected to said source and an output connected to said discharge means and constructed and arranged to normally provide a voltage at said output which is substantially equal to the operating voltage of said discharge means, said first means comprising an isolation transformer having a primary winding coupled to said source and a secondary winding coupled to said output and divided into first and second coil portions having a transformation ratio between said first and second coil portions substantially greater than one, second means coupled to said source and operative to derive thereform a substantially predetermined voltage, resistance means connected in series with said second means, and third means coupled to one of said coil portions for pulsing said one of said coil portions with at least a portion of said predetermined voltage and for inducing in the other coil portion a voltage which is functionally related to said transformation ratio and the magnitude of said pulse to thereby momentarily produce a starting voltage at said output which is substantially higher than the normal output voltage to render said discharge means conductive, at least one of said second and third means being rendered ineffective when said discharge means is conductive.

7. The apparatus set forth in claim 6 wherein said second means comprises energy storage means coupled to said source for being charged and said third means comprises switching circuit means coupled to said energy storage means and operable when the amount of stored energy in said energy storage means reaches a predetermined value to apply at least a portion of the voltage of said energy storage means across said one of said coil portions.

8. Apparatus for igniting and operating discharge means from an A.C. source, said discharge means being characterized by a relatively high starting voltage with respect to its operating voltage and the voltage of said source, first means having an input connected to said source and an output connected to said discharge means and constructed and arranged to normally provide a voltage at said output which is substantially equal to the operating voltage of said discharge means, said first means comprising a reactor-type ballast connected in series circuit relation between said source and said discharge device and divided into first and second coil portions having a transformation ratio between said first and second coil portions substantially greater than one, second means coupled to said source and operative to derive therefrom a substantially predetermined voltage, resistance means connected in series with said second means, and third means coupled to one of said coil portions for pulsing said one of said coil portions with at least a portion of said predetermined voltage and for inducing in the other coil portion a voltage which is functionally related to said transformation ratio and the magnitude of said pulse to thereby momentarily produce a starting voltage at said output which is substantially higher than the normal output voltage to render said discharge means conductive, at least one of said second and third means being rendered ineffective when said discharge means is conductive.

9. The apparatus set forth in claim 8 wherein said second means comprises energy storage means coupled to said source for being charged and said third means comprises switching circuit means coupled to said energy storage means and operable when the amount of stored energy in said energy storage means reaches a predetermined value to apply at least a portion of the voltage of said energy storage means across said one of said coil portions.

* * * * *

UNITED STATES PATENT AND TRADEMARK OFFICE

CERTIFICATE OF CORRECTION

PATENT NO. : 3,963,958

DATED : June 15, 1976

INVENTOR(S) : Joe A. Nuckolls

It is certified that error appears in the above-identified patent and that said Letters Patent are hereby corrected as shown below:

Col. 4, line 38, --4. A circuit as defined in claim 2, including a high--

Col. 4, line 42, --5. A circuit as defined in claim 2, including a ballast--

Signed and Sealed this

*Tenth* Day of *August 1982*

[SEAL]

*Attest:*

GERALD J. MOSSINGHOFF

*Attesting Officer*

*Commissioner of Patents and Trademarks*